US009410777B2

(12) United States Patent
Martin et al.

(10) Patent No.: US 9,410,777 B2
(45) Date of Patent: Aug. 9, 2016

(54) SYSTEMS AND APPARATUSES FOR A BALLISTIC ARROW

(71) Applicant: William David Hand, Houston, TX (US)

(72) Inventors: Nathan Martin, Pasadena, CA (US); Manuel N. Rivera-Valdivia, Houston, TX (US); Andrew Sydow, Bloomington, MN (US); Kyle Valley, Houston, TX (US)

(73) Assignee: BALLISTIC ARROW TECH, LLC, Houston, TX (US)

( * ) Notice: Subject to any disclaimer, the term of this patent is extended or adjusted under 35 U.S.C. 154(b) by 0 days.

(21) Appl. No.: 14/249,530

(22) Filed: Apr. 10, 2014

(65) Prior Publication Data

US 2014/0309065 A1 Oct. 16, 2014

Related U.S. Application Data

(60) Provisional application No. 61/810,549, filed on Apr. 10, 2013.

(51) Int. Cl.
*F42B 6/08* (2006.01)

(52) U.S. Cl.
CPC ..... *F42B 6/08* (2013.01)

(58) Field of Classification Search
CPC combination set(s) only.
See application file for complete search history.

(56) References Cited

U.S. PATENT DOCUMENTS 2,589,137 A * 3/1952 Ramsey ..... F42B 6/08 473/583
2,676,017 A * 4/1954 Selent ..... F42B 6/08 473/583
2,873,334 A 2/1959 Wirsching
2,874,968 A * 2/1959 Zielinski ..... F42B 6/08 43/6
3,759,519 A 9/1973 Palma
4,037,839 A 7/1977 Nelson
4,166,619 A 9/1979 Bergmann et al.
4,210,330 A * 7/1980 Kosbab ..... F42B 6/08 473/584
4,579,348 A 4/1986 Jones
4,976,443 A 12/1990 DeLucia
4,998,738 A 3/1991 Puckett
5,066,021 A 11/1991 DeLucia
5,082,292 A 1/1992 Puckett (Continued)

OTHER PUBLICATIONS

No Limit Archery, [retrieved from the Internet on Feb. 21, 2014 using URL<http://nolimitarchery.com/>].

(Continued)

*Primary Examiner* — John Ricci
(74) *Attorney, Agent, or Firm* — Sutton McAughan Deaver PLLC

(57) ABSTRACT

Applicants have created improved systems and apparatuses for a ballistic arrow used to penetrate the surface of a target. The apparatus includes an arrow tip, a support feature, and a collar partially disposed about the support feature. The apparatus further includes a plurality of primary blades disposed radially about the support feature and a plurality of secondary blades partially disposed between the primary blades. The system includes an arrowhead and arrow shaft coupled to the arrowhead. The arrowhead includes an arrow tip, a support feature, and a collar partially disposed about the support feature. The arrowhead includes a plurality of arrow blades adapted to expand radially outward from the support feature upon impact of the arrow tip with a target. The apparatuses and systems described throughout this disclosure can improve the both the reliability and lethality of a ballistic arrow used to hunt game and other wildlife.

21 Claims, 6 Drawing Sheets

(56) References Cited

U.S. PATENT DOCUMENTS

| | | | | |
|---|---|---|---|---|
| 5,096,205 | A | 3/1992 | Dudley | |
| 5,458,341 | A | 10/1995 | Forrest et al. | |
| 5,496,043 | A * | 3/1996 | Ester | F42B 6/08 473/584 |
| 6,077,180 | A * | 6/2000 | Adams, Jr. | F42B 6/08 473/584 |
| 6,863,630 | B1 * | 3/2005 | Watkins | F42B 6/08 473/583 |
| 7,226,375 | B1 | 6/2007 | Sanford | |
| 7,491,126 | B2 | 2/2009 | Jung | |
| 7,713,152 | B1 | 5/2010 | Tentler et al. | |
| 7,717,814 | B1 | 5/2010 | Sanford | |
| 8,043,178 | B2 * | 10/2011 | Sames | F42B 6/08 473/583 |
| 8,079,926 | B2 | 12/2011 | MacKey, Jr. et al. | |
| 8,167,748 | B2 * | 5/2012 | Butcher | F42B 6/08 473/583 |
| 8,414,432 | B1 | 4/2013 | Hand | |
| 2009/0203477 | A1 | 8/2009 | Mizek et al. | |
| 2012/0068036 | A1 | 3/2012 | Cerezo Lotina | |

OTHER PUBLICATIONS

Sonoran Bowhunting Products, Inc., [retrieved from the Internet on Nov. 5, 2013 using URL<http://www.sonoranbowhunting.com/>].

Bowhunting.net, [retrieved from the Internet on Nov. 5, 2013 using URL<http://www.bowhunting.net/artman/publish/NewProducts/New_Swhacker_Broadhead_Cuts_Through_printer.shtml/>].

Beaufume, C., International Search Report for International Patent Application No. PCT/US2014/032740, European Patent Office, dated Aug. 4, 2014.

Beaufume, C., Written Opinion for International Patent Application No. PCT/US2014/032740, European Patent Office, dated Aug. 4, 2014.

Ricci, J., International Preliminary Report on Patentability for International Patent Application No. PCT/US14/32740, IPEA/US, dated Sep. 11, 2015.

* cited by examiner

SYSTEMS AND APPARATUSES FOR A BALLISTIC ARROW

CROSS REFERENCE TO RELATED APPLICATIONS

The present application claims the benefit of U.S. provisional application 61/810,549 filed Apr. 10, 2013. The contents of the aforementioned application is incorporated herein by reference in its entirety.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The inventions disclosed and taught herein relate generally to improved systems and apparatuses for a ballistic arrow. In one aspect, the invention relates to an apparatus that includes primary and secondary arrow blades in a fixed configuration used for penetrating a target. In another aspect, the invention relates to an apparatus that includes one or more mechanically actuated blades that are adapted to deploy upon impact with a target, such as game, or other wildlife.

2. Description of the Related Art

Arrow heads, such as broadheads or the like, have been implemented in a variety of ways to improve the manner in which hunting arrows can penetrate a target when used to hunt game and other wildlife. Typical broadheads consist of several components (e.g., a shaft, a leading edge (such as a point), at least one blade, and a trailing edge (typically used to attach the broadhead to another component of the arrow used for hunting).

For example, U.S. Pat. No. 4,998,738 to Puckett discloses a broadhead hunting arrow that includes a pair of upper blades 24, a plunger tip 12, a cylindrical body 14, and threaded bottom 16. Furthermore, U.S. Pat. No. 6,517,454 to Barrie et al. discloses a broadhead with sliding, expanding blades that includes a broadhead body 11, a front, target penetrating end 11a, blades 13, 14, and rear end 20b.

The drawback to these solutions, however, is that they possess marginal lethality when penetrating a target, such as wildlife or other game. For example, broadheads embodying designs described above often merely create a slit-type entry cavity that wounds the target being hunted, without creating sufficient damage to effectively kill the intended target. Thus, the intended target either must endure a slow, painful death, or sustain a permanent injury as a result of the broadhead penetrating its body.

What is required, therefore, are improved systems and apparatuses for a ballistic arrow that are capable of increased lethality and effectiveness when penetrating a target. The inventions disclosed and taught herein are directed to systems and methods for an improved ballistic arrow that overcomes the problems as set forth above.

BRIEF SUMMARY OF THE INVENTION

Described are systems and apparatus for penetrating a surface of a target. The apparatus includes an arrow tip, a support feature, and a collar partially disposed about the support feature. The apparatus further includes a plurality of primary blades disposed radially about the support feature and a plurality of secondary blades partially disposed between the primary blades. The system includes an arrowhead and arrow shaft coupled to the arrowhead. The arrowhead includes an arrow tip, a support feature, and a collar partially disposed about the support feature. The arrowhead includes a plurality of arrow blades adapted to expand radially outward from the support feature upon impact of the arrow tip with a target. The apparatuses and systems described throughout this disclosure can improve the both the reliability and lethality of a ballistic arrow used to hunt game and other wildlife.

The disclosure also provides an apparatus for penetrating a surface of a target that can include an arrow tip that can further include first and second edges, a support feature adapted to couple to the first edge of the arrow tip, and a collar that can include a plurality of slots and further be adapted to be at least partially disposed about the support feature. The apparatus can further include a plurality of primary blades adapted to be disposed radially about the support feature and further adapted to be coupled with the support feature in an interlocking configuration.

The plurality of primary blades can further include one or more first flanges, wherein each of the first flanges is adapted to couple with one of the plurality of slots. Furthermore, the apparatus can include a plurality of secondary blades, wherein the at least one of the plurality of secondary blades is at least partially disposed between two of the plurality of primary blades and the plurality of secondary blades are adapted to be coupled with the plurality of blades in an interlocking configuration.

The system for penetrating a surface of a target can include an arrowhead, wherein the arrowhead can include an arrow tip that can include first and second edges, a support feature adapted to couple to the first edge of the arrow tip, and a collar that can include a plurality of slots and further be adapted to be at least partially disposed about the support feature. The arrowhead can further include a plurality of primary blades adapted to be disposed radially about the support feature and further adapted to be coupled with the support feature in an interlocking configuration.

The plurality of primary blades can further include a first flange, wherein each of the first flanges is adapted to couple with one of the plurality of slots. Furthermore, the arrowhead can include a plurality of secondary blades, wherein the at least one of the plurality of secondary blades is at least partially disposed between two of the plurality of primary blades and the plurality of secondary blades are adapted to be coupled with the plurality of blades in an interlocking configuration. Additionally, the system can include an arrow shaft, wherein the arrow shaft is adapted to be operably coupled with the arrowhead.

The apparatus for penetrating a surface of a target can include an arrow tip that can include a first and second edges, a support feature adapted to couple to the first edge of the arrow tip, and a collar adapted to be at least partially disposed about the support feature. The apparatus can further include a plurality of arrow blades adapted to expand radially outward from the support feature and a plurality of blade mounts. Each of the plurality of arrow blades are adapted to rotate about at least one of the plurality of blade mounts and further adapted to rotate with respect to the support feature.

The expansion of the plurality of arrow blades can be at least partially regulated by the position of the collar with respect to the arrow tip. Additionally, the plurality blades are adapted to expand radially outward from the support feature upon impact of the second edge of the arrow tip with the target and the collar is adapted to be axially displaced along the support feature upon impact with the target. Furthermore, the axial displacement of the collar is adapted to facilitate the expansion of the plurality of arrow blades.

The system for penetrating a surface of a target can include an arrowhead, wherein the arrowhead can include an arrow tip that can include first and second edges, a support feature adapted to couple to the first edge of the arrow tip, and a collar adapted to be at least partially disposed about the support feature. The arrowhead can further include a plurality of arrow blades adapted to expand radially from the support feature and a plurality of blade mounts. Each of the plurality of arrow blades are adapted to rotate about at least one of the plurality of blade mounts and further adapted to rotate with respect to the support feature. The expansion of the plurality of arrow blades can be at least partially regulated by the position of the collar with respect to the arrow tip.

Additionally, the plurality blades are adapted to expand radially outward from the support feature upon impact of the second edge of the arrow tip with the target and the collar is adapted to be axially displaced along the support feature upon impact with the target. Furthermore, the axial displacement of the collar is adapted to facilitate the expansion of the plurality of arrow blades. Finally, the system can include an arrow shaft, wherein the arrow shaft is adapted to be operably coupled with the arrowhead.

BRIEF DESCRIPTION OF THE SEVERAL VIEWS OF THE DRAWINGS

The following figures form part of the present specification and are included to further demonstrate certain aspects of the present invention. The invention may be better understood by reference to one or more of these figures in combination with the detailed description of specific embodiments presented herein.

Figure 1:
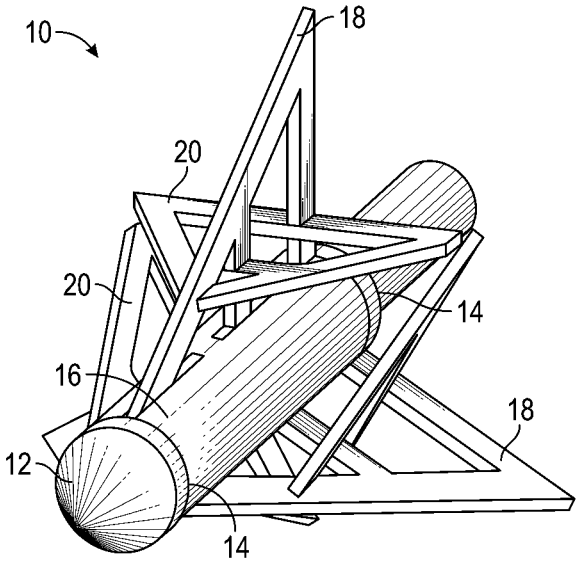
FIG. 1 illustrates a perspective view of a first embodiment of an apparatus for penetrating the surface of a target.

While the inventions disclosed herein are susceptible to various modifications and alternative forms, only a few specific embodiments have been shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

DETAILED DESCRIPTION

The Figures described above and the written description of specific structures and functions below are not presented to limit the scope of what Applicants have invented or the scope of the appended claims. Rather, the Figures and written description are provided to teach any person skilled in the art to make and use the invention for which patent protection is sought.

Those skilled in the art will appreciate that not all features of a commercial embodiment of the invention are described or shown for the sake of clarity and understanding. Persons of skill in this art will also appreciate that the development of an actual commercial embodiment incorporating aspects of the present invention will require numerous implementation-specific decisions to achieve the developer's ultimate goal for the commercial embodiment. Such implementation-specific decisions may include, and likely are not limited to, compliance with system-related, business-related, government-related, and other constraints, which may vary by specific implementation, location and from time to time. While a developer's efforts might be complex and time-consuming in an absolute sense, such efforts would be, nevertheless, a routine undertaking for those of skill in this art having benefit of this disclosure.

It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

The terms "couple," "coupled," "coupling," "coupler," and like terms are used broadly herein and can include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and can further include without limitation integrally forming one functional member with another in a unity fashion. The coupling can occur in any direction, including rotationally.

Applicants have created improved systems and apparatuses for a ballistic arrow used to penetrate the surface of a target. The apparatus includes an arrow tip, a support feature, and a collar partially disposed about the support feature. The apparatus further includes a plurality of primary blades disposed radially about the support feature and a plurality of secondary blades partially disposed between the primary blades. The system includes an arrowhead and arrow shaft coupled to the arrowhead. The arrowhead includes an arrow tip, a support feature, and a collar partially disposed about the support feature. The arrowhead includes a plurality of arrow blades adapted to expand radially outward from the support feature upon impact of the arrow tip with a target. The apparatuses and systems described throughout this disclosure can improve the both the reliability and lethality of a ballistic arrow used to hunt game and other wildlife.

Turning now to the figures, FIG. 1 illustrates a perspective view of a first embodiment of an apparatus for penetrating the surface of a target. The apparatus 10 can include an arrow tip 12, a support feature 16 adapted to couple to an edge of the arrow tip 12, and a collar 14 adapted to be at least partially disposed about the support feature 16. The apparatus 10 can further include a plurality of primary blades 18 adapted to be disposed radially about the support feature 16; and a plurality of secondary blades 20, wherein the at least one of the plurality of secondary blades 20 is at least partially disposed between two of the plurality of primary blades 18. These features are described in greater detail below in conjunction with FIGS. 2A-2E.

Figure 2A:
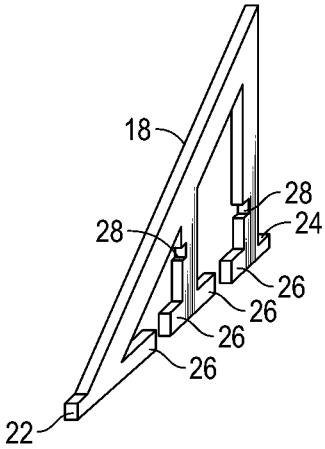
FIG. 2A illustrates a perspective view of the primary blade of the first embodiment of the apparatus for penetrating a surface of a target as shown in FIG. 1.
Figure 2B:
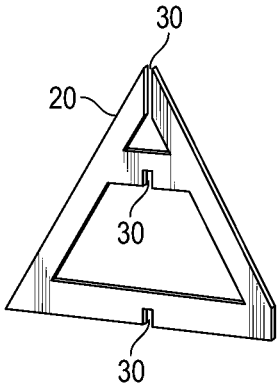
FIG. 2B illustrates a perspective view of the secondary blade of the first embodiment of the apparatus for penetrating a surface of a target as shown in FIG. 1.
Figure 2C:
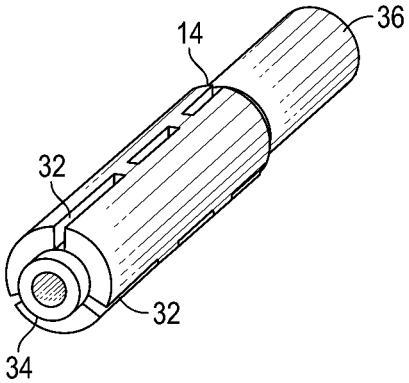
FIG. 2C illustrates a perspective view of the support feature of the first embodiment of the apparatus for penetrating a surface of a target as shown in FIG. 1.
Figure 2D:
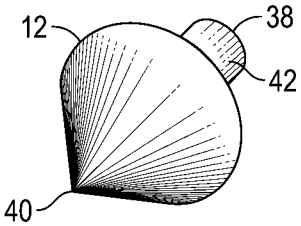
FIG. 2D illustrates a perspective view of the arrow tip of the first embodiment of the apparatus for penetrating a surface of a target as shown in FIG. 1.
Figure 2E:
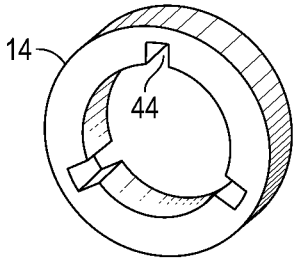
FIG. 2E illustrates a perspective view of the collar of the first embodiment of the apparatus for penetrating a surface of a target as shown in FIG. 1

FIG. 2A illustrates a perspective view of the primary blade of the first embodiment of the apparatus for penetrating a surface of a target as shown in FIG. 1. FIG. 2B illustrates a perspective view of the secondary blade of the first embodiment of the apparatus for penetrating a surface of a target as shown in FIG. 1. FIG. 2C illustrates a perspective view of the support feature of the first embodiment of the apparatus for penetrating a surface of a target as shown in FIG. 1. FIG. 2D illustrates a perspective view of the arrow tip of the first embodiment of the apparatus for penetrating a surface of a target as shown in FIG. 1. FIG. 2E illustrates a perspective view of the collar of the first embodiment of the apparatus for penetrating a surface of a target as shown in FIG. 1. These Figures will be described in conjunction with one another.

The arrow tip 12 be conically shaped, although other suitable geometric shapes are contemplated as well (e.g., a tetrahedron). For the example illustrated FIG. 2D, arrow tip 12 can be conically shaped to create an initial puncture into a target upon impact. Arrow tip 12 can function as a simple machine (e.g., wedge) which, as a result, can reduce the force required to penetrate the target. In the example of a conically shaped arrow tip 12, the conical angle of the arrow tip 12 can vary in order to adjust the resulting impact of arrow tip 12 on a target.

Arrow tip 12 can include a first edge 38 and a second edge 40. In one example, second edge 40 can terminate at a single point that can include a leading edge for penetrating a target (not shown). Arrow tip 12 can be coupled to the support feature 16 with the use of a first coupler (not shown) such as threads or other mating mechanisms to mate the connection at the first edge 38 of arrow tip 12 (such as, for example, a male connection) to the support feature leading edge 34 (such as, for example, female connection inside of the center support feature 16). First edge 38 can be supported by arrow tip support 42 and can be disposed between first edge 38 and second edge 40 of arrow tip 12.

Arrow tip 12 can be made of steel, plastic, or any other suitable material for penetrating a target (such as, for example, game or other wildlife). Arrow tip 12 can be coupled to support feature 16 and collar 14 when apparatus 10 is assembled. Collar 14, when disposed at least partially about support feature 16, can be used to couple primary blades 18 to support feature 16. For example, in one embodiment, three of such primary blades 18 can be employed. As primary blade 18 is coupled to support feature 16, first flange 22 can be coupled (such as, for example, through lock-fit coupling, snap-fit, slide-type interlocking, etc.) to support feature slots 32. Furthermore, second flange 24 and primary blade flanges 26 can be coupled to support feature slots 32 through a slide-type interlocking, snap-fit coupling, lock-fit coupling, etc., to further couple primary blade 18 to support feature 16.

Collar 14 can assist in coupling the one or more primary blades 18 to support feature 16. Collar 14 can be composed of steel, plastics, or any other suitable material for securing primary blades 18 to support feature 16. Collar 14 can include one or more collar slots 44 that can be designed to match the height and width of first flange 22. That is, collar slots 44 can be milled (or otherwise formed, shaped, manufactured, etc.) to secure primary blades 18 in place by coupling first flange 22 to collar slot 44. For example, collar 14 can fit over the protrusion on the front of support feature 16 by sliding the collar 14 over the support feature leading edge 34 after one or more of the primary blades 18 are coupled to support feature 16.

Once in place, collar 14 can be secured by coupling arrow tip 12 to support feature leading edge 34 (such as by threading, etc.). In this configuration, primary blades 18 can be secured because primary flanges 26 can be coupled to support feature slots 32 and first flange 22 can be coupled to collar slot 44, thus preventing primary blade 18 from being decoupled from support feature 16.

A second collar 14 can be at least partially disposed about support feature 16 by sliding collar 14 over the support feature trailing edge 36. In this configuration, collar slots 44 can couple to second flange 24 of primary blade 18 in a similar manner as described above in conjunction with first flange 22. With these collars 14 in place, movement (axially, laterally, rotational, etc.) of primary blades 18 with respect to support feature 16 can be prevented until collar 14 is decoupled from support feature 16.

Support feature 16 can be formed of aluminum, plastic, steel, or any other material suitable for supporting primary blades 18 and secondary blades 20. In one embodiment, support feature 16 can be hollow in order to reduce its overall weight without significantly reducing its strength. Because support feature 16 can be formed as a hollow member without causing degradation in its overall strength and further increase the amount of weight support feature 16 can support, support feature 16 can support larger primary blades 18 and secondary blades 20 in order to increase the overall cutting diameter of apparatus 10. Although depicted in the Figures as being triangular in shape, primary blades 18 and secondary blades 20 can be implemented in a variety of other geometric shapes as well.

Primary blades 18 can include one or more surfaces for cutting a target. For example, when primary blade 18 penetrates a target, it can create a large laceration and or entry/exit holes. In one example, primary blade 18 (and secondary blade 20 as described below) can include one or more razor blades. Furthermore, the angle of primary blades 18 (e.g., angle between the surface of primary blade 18 coupled to support feature 16 and the outer surface (e.g., cutting surface) of primary blade 18 that tapers to first flange 22) can form a wedge, thus increasing the power and lethality of the device as it penetrates its target.

Primary blades slots 28 can be used to couple secondary blades 20 to primary blades 18. For example, secondary blade slot 30 can be coupled to primary blade slot 28 to secure secondary blades 20 to primary blades 18. In one example, secondary blade slot 30 can be slide into primary blade slot 28 and locked into place. In this example, primary blade slots 28 and secondary blade slots 30 can be matched (e.g., secondary blade slots 30 can be thinner than primary blade slots 28) such that the slot-to-slot connection holds the primary blades 18 and secondary blades 20 into place.

Secondary blades 20 can include secondary cutting mechanisms and can further act to make additional cuts into a target (e.g., circular cuts, semi-circular cuts, etc.). These secondary blades 20 can increase the cut size in the target that is created by primary blades 18. In this regard, apparatus 10 can increase the opening created in a target once penetrated.

Secondary blades 30 can be slid into primary blades 18 via the gaps between the primary blade flanges 26 and subsequently locked into place via the slot-to-slot coupling described above, relying on frictional and/or contact forces between the primary blades 18 and secondary blade 20. Secondary blades 20 can be disposed at non-orthogonal angles with respect to primary blades 18 (other orthogonal angles can work equally as well). For example, secondary blades 20 can be graded at a four degree gradient with respect to the axial axis of primary blades 18 so that the second edge 40 of arrow tip 12 is slightly higher than the first edge 38.

This configuration, when combined with the cutting mechanisms previously elaborated upon above, can be employed to cut a piece of the target fully away from its surroundings and drag it forward with the device as the device moves through the target. Although a four-degree gradient is specifically disclosed, other angles, greater than or less than four degrees are contemplated as well. Furthermore, the secondary blades 20 can be disposed orthogonally with respect to primary blades 18 such that second end 40 of arrow tip 12 is not higher or lower than front end 38 of arrow tip 12.

Apparatus 10 described above can be used to facilitate hunting and other sport-targeting events (e.g., used in conjunction with a high-wound rate bow hunting device). With the increased reliability and lethality resulting from this configuration, the intended target (e.g., white-tailed deer) can be killed more humanely. This is due, in part, to the increased cavity that can be created by apparatus 10 when penetrating the target. For example, the primary blades 18 and secondary blades 20 can be used to increase the cutting diameter of the entry wound (e.g., thirty-percent greater, although other percentages greater than or less than thirty-percent are contemplated as well). With an increased cutting diameter, the apparatus 10 can produce a large blood trail that can result in a hunter's improved ability to track the targeted animal so that it can be harvested soon after it is shot.

Further, primary blades 18 and secondary blades 20 can be configured in such a manner that results in a circular-shaped cut pattern which, when combined with arrow tip 12 gradient described above. This can result in creating a pull plug as the apparatus 10 is removed from the target, thus resulting in increased hemorrhaging in the target, a larger exit wound, and a quicker death of the target. Additional variations of apparatus 10 can include varying the position of the secondary blades 20, improvements to the interlocking mechanisms between the support feature 16, primary blades 18, and secondary blades 20, increasing the radial distance from the support feature 16 to a terminating edge of the primary blades 18 and/or the secondary blades 20.

Figure 3A:
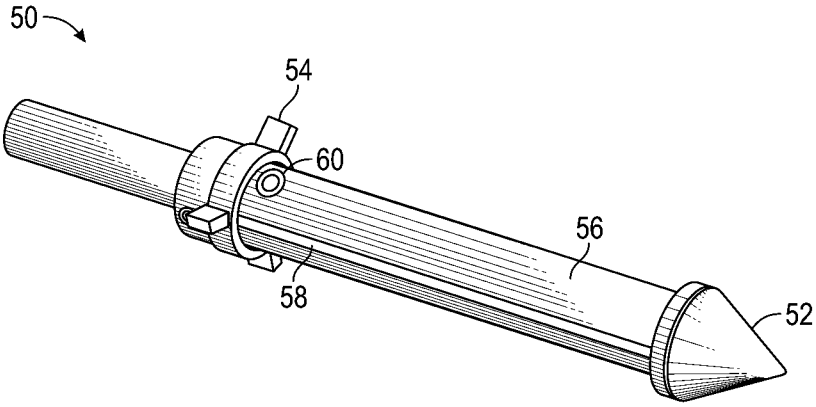
FIG. 3A illustrates a perspective view of a second embodiment of an apparatus for penetrating the surface of a target in a first configuration.
Figure 3B:
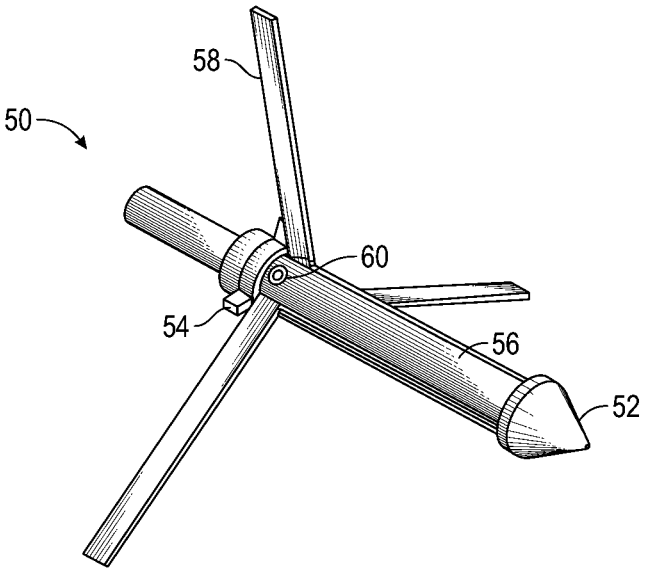
FIG. 3B illustrates a perspective view of a second embodiment of an apparatus for penetrating the surface of a target in a second configuration.

FIG. 3A illustrates a perspective view of a second embodiment of an apparatus for penetrating the surface of a target in a first configuration. FIG. 3B illustrates a perspective view of a second embodiment of an apparatus for penetrating the surface of a target in a second configuration. These Figures will be described in conjunction with one another.

Apparatus 50 can include an arrow tip 52 that can include first and second edges 62 and 64, respectively. Apparatus 50 can further include a support feature 56 that can be coupled to first edge 62 of arrow tip 52 and collar 54 that can be at least partially disposed about the support feature 56. Apparatus 50 can further include a plurality of arrow blades 58 adapted to expand radially outward from the support feature 56, and a plurality of blade mounts 60, wherein the expansion of the plurality of arrow blades 58 is at least partially regulated by the position of the collar 54 with respect to the arrow tip 52. FIG. 3A illustrates apparatus 50 in a closed or undeployed configuration. FIG. 3B illustrates apparatus 50 in an open or deployed configuration. The features of apparatus 50 will be described in greater detail in conjunction with FIGS. 4A-4E, below.

Figure 4A:
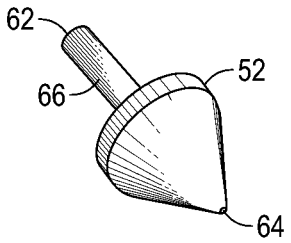
FIG. 4A illustrates a perspective view of the arrow tip of the second embodiment of the apparatus for penetrating a surface of a target as shown in FIGS. 3A and 3B.
Figure 4B:
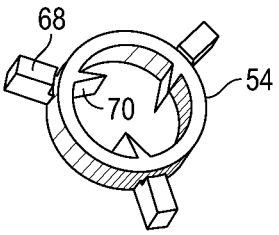
FIG. 4B illustrates a perspective view of the collar of the second embodiment of the apparatus for penetrating a surface of a target as shown in FIGS. 3A and 3B.
Figure 4C:
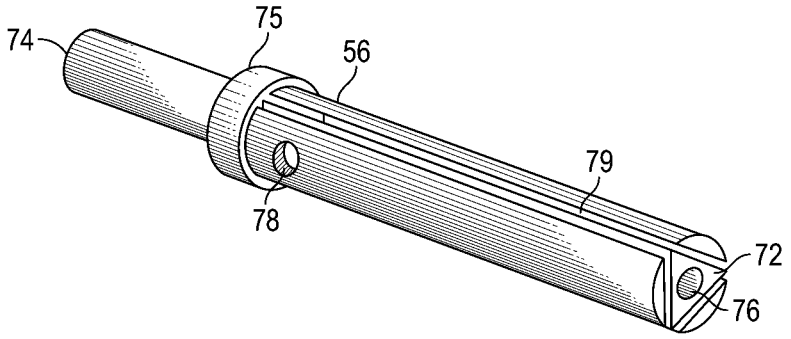
FIG. 4C illustrates a perspective view of the support feature of the second embodiment of the apparatus for penetrating a surface of a target as shown in FIGS. 3A and 3B.
Figure 4D:
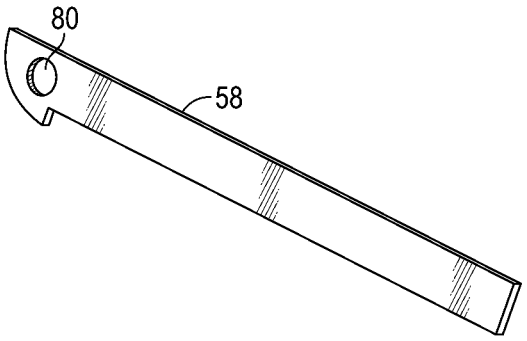
FIG. 4D illustrates a perspective view of the arrow blade of the second embodiment of the apparatus for penetrating a surface of a target as shown in FIGS. 3A and 3B.
Figure 4E:
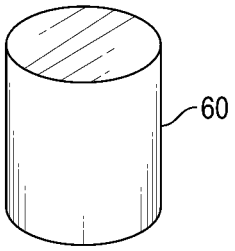
FIG. 4E illustrates a perspective view of the blade mount of the second embodiment of the apparatus for penetrating a surface of a target as shown in FIGS. 3A and 3B.

FIG. 4A illustrates a perspective view of the arrow tip of the second embodiment of the apparatus for penetrating a surface of a target as shown in FIGS. 3A and 3B. FIG. 4B illustrates a perspective view of the collar of the second embodiment of the apparatus for penetrating a surface of a target as shown in FIGS. 3A and 3B. FIG. 4C illustrates a perspective view of the support feature of the second embodiment of the apparatus for penetrating a surface of a target as shown in FIGS. 3A and 3B. FIG. 4D illustrates a perspective view of the arrow blade of the second embodiment of the apparatus for penetrating a surface of a target as shown in FIGS. 3A and 3B. FIG. 4E illustrates a perspective view of the blade mount of the second embodiment of the apparatus for penetrating a surface of a target as shown in FIGS. 3A and 3B. These Figures will be described in conjunction with one another.

The arrow tip 52 be conically shaped, although other suitable geometric shapes are contemplated as well (e.g., tetrahedron). For the example illustrated FIG. 4A, arrow tip 52 can be conically shaped to create an initial puncture into a target upon impact. Arrow tip 52 can function as a simple machine (e.g., wedge) which, as a result, can reduce the force required to penetrate the target. In the example of a conically shaped arrow tip 52, the conical angle of the arrow tip 52 can vary in order to adjust the resulting impact of arrow tip 52 on a target.

Arrow tip 52 can include a first edge 62 and a second edge 64. In one example, second edge 64 can terminate at a single point that can include a leading edge for penetrating a target (not shown). Arrow tip 52 can be coupled to the support feature 56 with the use of a first coupler (not shown) such as threads or other mating mechanism to mate the connection at the first edge 62 of arrow tip 52 (e.g., a male connection) to the support feature leading edge 72 (such as, for example, female connection inside of the center support feature 56—e.g., to mate with the arrow tip receiving slot 76). First edge 62 can be supported by arrow tip support 66 that can be disposed between first edge 62 and second edge 64 of arrow tip 52. Furthermore, arrow tip 52, once coupled support feature 56, can restrict the axial and/or lateral movement of collar 54 about support feature 56.

Arrow tip 52 can be made of steel, plastics, aluminum (e.g., 1060 aluminum), or any other suitable material for penetrating a target (such as, for example, game or other wildlife). Arrow tip 52 can be coupled to support feature 16 and collar 54 when apparatus 50 is assembled. Collar 54, when disposed at least partially about support feature 56, can be used to couple arrow blades 58 to support feature 56. For example, in one embodiment, three of such arrow blades 58 can be employed.

Collar 54 can assist in coupling the one or more arrow blades 58 to support feature 56. Collar 54 can be composed of steel, plastics, or any other suitable material for securing arrow blades 58 to support feature 56. Collar 54 can include one or more collar guides 70 that can be designed to match the height and width of the support feature slots 79. Collar 54 can mount radially over support feature 56 and its position can be adjusted axially along support feature 56. Support feature 56 can further include a raised portion 75 near the trailing edge 74 such that the axially movement of the collar 54 is restricted by the raised portion 75 near the trailing edge 74 and its axial movement towards the leading edge 72 can be restricted by the arrow tip 52.

Collar 54 can act as a barrier to prevent arrow blades 58 through mechanical fracture, bending, or the like, upon impact with the target. Collar 54 can prevent this failure because it can prevent the radial expansion of the arrow blades 58 while the collar 54 is positioned distally from raised edge 75, and towards support feature leading edge 72.

The outer diameter of collar 54 can be defined by the outer edges of the collar stops 68 which, in one particular example, can be larger than the outer diameter of the arrow tip 52. In this configuration, as arrow tip 52 penetrates a target, the color stops 68 can catch on portions of the target not penetrated by the arrow tip 52. Once the collar stops 68 make contact, the collar 54 can be moved axially along the support feature 54 towards the support feature trailing edge 74 until it reaches the raised portion 75. By doing so, the kinetic energy and forward momentum of the apparatus 50 can force the collar 54 to push into the target and allow the apparatus 50 to continue its trajectory.

Furthermore, collar 54 can facilitate the forced radial displacement of the arrow blades 58 after the apparatus 50 has penetrated through the outer layer of the target and it can further be employed to lock the arrow blades 58 in an open or deployed position. As collar 54 contacts the raised portion 75 of support feature 56 and locks, the arrow blades 58 can deploy (such as, for example, through a spring-like action or other mechanical means) from the closed position to the open position by releasing the arrow blades 58 as a result of the forward momentum of apparatus 50 and the reaction forces opposing the forward motion of apparatus 50.

The collar 54 can be held in its position towards the support feature trailing edge 74 (e.g., abutting raised portion 75 by the forward momentum of apparatus 50 and the reaction forces opposing the forward motion of apparatus 50). When in this configuration, half of collar 54 can contact the base of arrow blades 58 and blade mounts 60. The blade mounts 60 can rotate (for example, forty-five degrees, although angles greater than or less than forty-five are contemplated as well) as the arrow blades 58 deploy. The frictional contact forces between collar 54 and support feature 56 can prevent blade support 60 from counter-rotating back to its initial position. In this regard, the blade mounts 60 can assist to prevent arrow blades 58 from opening prior to penetration of the apparatus 50 into the target and lock arrow blades 58 in a position (e.g., an open position) once apparatus 50 penetrates a target.

The collar 54 can be designed to function with unhindered, free axial movement along the support feature 56. Any geometric designs different than those illustrated by the Figures herein can be employed as well. The support feature 56 can be composed of aluminum, steel, plastics, or another other suitable material for support arrow blades 58 and arrow tip 52.

In an exemplary and non-limiting illustrative embodiment, apparatus 50 can include three arrow blades 56, however, more than or fewer than three blades can be employed as well. In one example, the leading and front edges of arrow blades 58 can be sharpened and the trailing edge can remain dull. The sharpened edges can lacerate the target as the apparatus 50 penetrates through it, and these edges can further create large exit holes as the device exits the target. The arrow blades 58 can be coupled to support feature 56 with the aid of the blade mounts 60 to facilitate the arrow blades' 58 radial movement. As the arrow blades 58 open radially, than can be swept backward until they rest at a forty-five degree angle (although other angles greater than or less than forty-five degrees are contemplated as well). In one example, the arrow blades 58 can be composed of stainless steel, although other materials, such as steel, plastics, etc. can be employed as well.

The geometry and size of arrow blades 60 is only restrained by the distance between the support feature 56 and collar 54 (e.g., height differential between these two elements) and the length of the support feature 56 (e.g., between the first edge 62 of arrow tip 52 and the raised portion 75 of the support feature 56). With this design, the structural integrity of arrow blades 58 can be increased, thus increasing the overall effectiveness and lethality of the apparatus 50.

Blade mounts 60 can be composed of steel, plastics, or any other material suitable for mounting arrow blades 58 to support feature 56. For example, blade mounts 60 can be composed of steel because it is possesses a high yield strength and stress tolerance. Further, blade mounts 60 can be coupled to the support feature 56 with the aid of a coupler (not shown) such as, for example screws, fasteners, or the like. The arrow blades 58 can be coupled to the support feature 56 by aligning the blade receiving slot 80 with the blade mounting receiving slot 78. Once aligned, the blade mounts 60 can be used to anchor the arrow blades 58 (such as, for example, using pins).

In an exemplary and non-limiting illustrative embodiment, blade mounts 60 can be geometric half-right cylinders, although other geometries are contemplated as well. Blade mounts 60 can be coupled to the support feature 56 through the use of couplers (not shown), such as, for example, screws, clips, or the like. Once coupled, blade mounts 60 can be free to rotate into order to facilitate the sweeping motion of arrow blades 58 from the un-deployed configuration to the deployed configuration. When collar 54 is positioned nearest to the first edge 62 of arrow tip 52, blade mounts 60 can be prevented from rotating back, thus forcing arrow blades 58 in the open position.

Apparatus 50 described above can be used to facilitate hunting and other sport-targeting events (e.g., used in conjunction with a high-wound rate bow hunting device). With this increased reliability and lethality, the intended target (e.g., white-tailed deer) can be killed more humanely. This is due, in part, to the increased cavity that can be created by apparatus 50 when penetrating the target. For example, with the arrow blades 58 can be used to increase the cutting diameter of the entry wound (e.g., seventeen-percent greater, although other percentages greater than or less than seventeen-percent are contemplated as well). With an increased cutting diameter, the apparatus 50 can produce a large blood trail that can result in a hunter's improved ability to track the targeted animal so that it can be harvested soon after it is shot. Moreover, the collar 54 can increase the reliability of the deployment of the arrow blades 58 by at least fifty percent.

Figure 5:
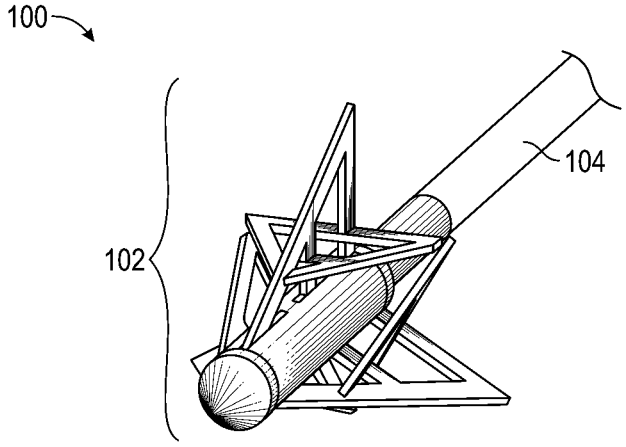
FIG. 5 illustrates a perspective view of a first embodiment of a system for penetrating the surface of a target including the apparatus as shown in FIG. 1.
Figure 6:
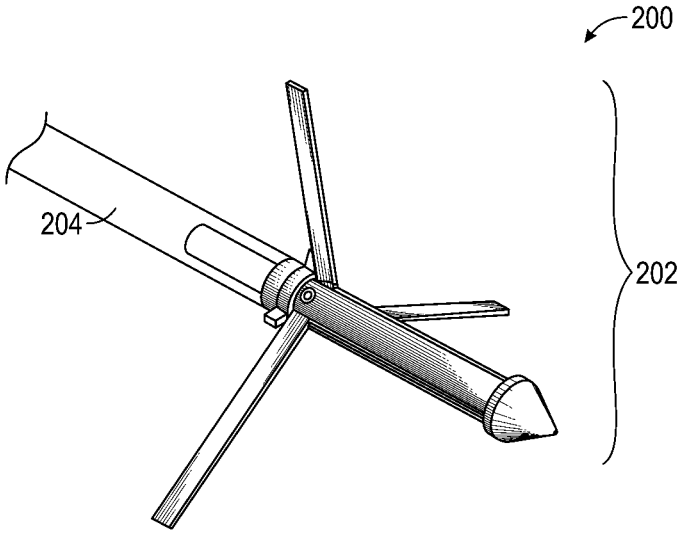
FIG. 6 illustrates a perspective view of a second embodiment of a system for penetrating the surface of a target including the apparatus as shown in FIG. 3B.

FIG. 5 illustrates a perspective view of a first embodiment of a system for penetrating the surface of a target including the apparatus as shown in FIG. 1. FIG. 6 illustrates a perspective view of a second embodiment of a system for penetrating the surface of a target including the apparatus as shown in FIG. 3B. These Figures will be described in conjunction with one another.

Referring specifically to FIG. 5, the system 100 can include an arrowhead 102 (such as the apparatus 10 described in conjunction with FIGS. 1-2 although other arrowheads are contemplated as well) and an arrow shaft 104. Arrow shaft 104 can include any arrow shaft suitable for coupling to arrow head 102 used to penetrate a target such as, for example, game, or other wildlife. Referring specifically to FIG. 6, the system 200 can include an arrowhead 202 (such as the apparatus 10 described in conjunction with FIGS. 3-4 although other arrowheads are contemplated as well) and an arrow shaft 204. Arrow shaft 204 can include any arrow shaft suitable for coupling to arrow head 202 used to penetrate a target such as, for example, game, or other wildlife.

For purposes of clarity and understanding, one or more of these components may not be specifically described or shown while, nevertheless, being present in one or more embodiments of the invention, such as in a commercial embodiment, as will be readily understood by one of ordinary skill in the art.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions. Discussion of singular elements can include plural elements and vice-versa.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range or equivalent of the following claims.

What is claimed is:

1. An apparatus for penetrating a surface of a target, the apparatus comprising:
- an arrow tip comprising a first and second edges;
- a support feature adapted to couple to the first edge of the arrow tip;
- a collar adapted to be at least partially disposed about the support feature;
- a plurality of primary blades adapted to be disposed radially about the support feature; and
- a plurality of secondary blades, at least one of which is at least partially disposed between two of the plurality of primary blades without contacting the support feature.

2. The apparatus according to claim 1 wherein the plurality of primary blades are adapted to be coupled with the support feature in an interlocking configuration.

3. The apparatus according to claim 1, wherein the collar further comprises a plurality of first slots.

4. The apparatus according to claim 3, wherein each of the plurality of primary blades further comprise a first flange, wherein each of the first flanges are adapted to couple with one of the plurality of slots.

5. The apparatus according to claim 1, wherein the plurality of secondary blades are adapted to be coupled with the plurality of primary blades in an interlocking configuration.

6. The apparatus of claim 1, wherein the support feature is hollow.

7. A system for penetrating a surface of a target, the system comprising:
- an arrowhead, wherein the arrowhead further comprises:
  - an arrow tip comprising a first and second edges;
  - a support feature adapted to couple to the first edge of the arrow tip;
  - a collar adapted to be at least partially disposed about the support feature;
  - a plurality of primary blades adapted to be disposed radially about the support feature; and
  - a plurality of secondary blades, at least one of which is at least partially disposed between two of the plurality of primary blades and is configured to be coupled with the two primary blades in an interlocking configuration.

8. The system according to claim 7 wherein the plurality of primary blades are adapted to be coupled with the support feature in an interlocking configuration.

9. The system according to claim 7, wherein the collar further comprises a plurality of first slots.

10. The system according to claim 9, wherein each of the plurality of primary blades further comprise a first flange, wherein each of the first flanges are adapted to couple with one of the plurality of slots.

11. The system according to claim 7, wherein the plurality of secondary blades are adapted to be coupled with the plurality of primary blades in an interlocking configuration.

12. The system of claim 7, wherein the support feature is hollow.

13. The system of claim 7, wherein the at least one interlocking secondary blade does not contact the support.

14. An arrowhead, comprising:
- a tip comprising a point;
- a support body configured at one end to engage the tip;
- a plurality of primary blades configured to engage the support body so that a portion of each primary blade extends radially from the support body;
- a plurality of secondary blades each configured to engage a primary blade at a location spaced apart from the support body;
- a collar configured to engage the support body between the tip and the primary blades; and
- wherein the tip, collar and support body are configured to operatively cooperate to lock the primary blades to the support body.

15. The arrowhead of claim 14, wherein the tip is conically shaped.

16. The arrowhead of claim 15, wherein the tip has threading engagement with the support body end.

17. The arrowhead of claim 14, further comprising a second collar configured to operatively cooperate with the support body to lock the primary blades to the support body.

18. The arrowhead of claim 14, wherein the primary and secondary blades are oriented relative to the support body and each other so that a circular cut pattern is created.

19. The arrowhead of claim 14, wherein the primary and secondary blades are oriented relative to the support body and each other so that a pull plug is created when the arrowhead is removed from a target.

20. The arrowhead of claim 14, wherein the primary blades are triangularly shaped.

21. The arrowhead of claim 14, wherein the support body is hollow.

* * * * *